US009653766B2

(12) United States Patent
Hagensen

(10) Patent No.: US 9,653,766 B2
(45) Date of Patent: May 16, 2017

(54) POLARIZER AND A METHOD OF OPERATING THE POLARIZER

(71) Applicant: THRANE & THRANE A/S, Kgs. Lyngby (DK)

(72) Inventor: Morten Hagensen, Hilleroed (DK)

(73) Assignee: THRANE & THRANE A/S, Lyngby (DE)

( * ) Notice: Subject to any disclaimer, the term of this patent is extended or adjusted under 35 U.S.C. 154(b) by 0 days.

(21) Appl. No.: 14/760,008

(22) PCT Filed: Jan. 11, 2013

(86) PCT No.: PCT/EP2013/050475
§ 371 (c)(1),
(2) Date: Jul. 9, 2015

(87) PCT Pub. No.: WO2014/108203
PCT Pub. Date: Jul. 17, 2014

(65) Prior Publication Data
US 2015/0357695 A1 Dec. 10, 2015

(51) Int. Cl.
*H01P 1/165* (2006.01)
*H01P 1/161* (2006.01)
*H01P 1/17* (2006.01)

(52) U.S. Cl.
CPC ..... *H01P 1/161* (2013.01); *H01P 1/173* (2013.01)

(58) Field of Classification Search
CPC .. H01P 1/16; H01P 1/161; H01P 1/165; H01P 1/17; H01P 1/173
USPC ..... 333/21 A, 21 R
See application file for complete search history.

(56) References Cited

U.S. PATENT DOCUMENTS

| | | | | |
|---|---|---|---|---|
| 2,730,677 | A * | 1/1956 | Boissinot | H01P 1/163 333/122 |
| 3,215,957 | A | 11/1965 | Dantzig | |
| 4,613,836 | A | 9/1986 | Evans | |
| 4,806,945 | A | 2/1989 | Cormier et al. | |
| 6,507,323 | B1 | 1/2003 | West | |
| 9,318,807 | B2 * | 4/2016 | McCarrick | H01Q 13/0241 |
| 2003/0030590 | A1 | 2/2003 | Gau et al. | |

FOREIGN PATENT DOCUMENTS

KR 20100131147 A 12/2010

OTHER PUBLICATIONS

International Search Report PCT/ISA/210 for International Application No. PCT/EP2013/050475 dated Sep. 18, 2013.
Written Opinion of the International Searching Authority PCT/ISA/237 for International Application No. PCT/EP2013/050475 dated Sep. 18, 2013.

* cited by examiner

*Primary Examiner* — Robert Pascal
*Assistant Examiner* — Kimberly Glenn
(74) *Attorney, Agent, or Firm* — Harness, Dickey & Pierce, PLC

(57) ABSTRACT

A polarizer, such as a septum polarizer, which may alter between two states wherein, effectively, the septum is rotated 180 degrees around the longitudinal axis of the waveguide so that the polarization of the signals in the waveguide may easily be altered without having to alter receivers/transmitters connected to the waveguide.

12 Claims, 7 Drawing Sheets

PRIOR ART

Figure 1:
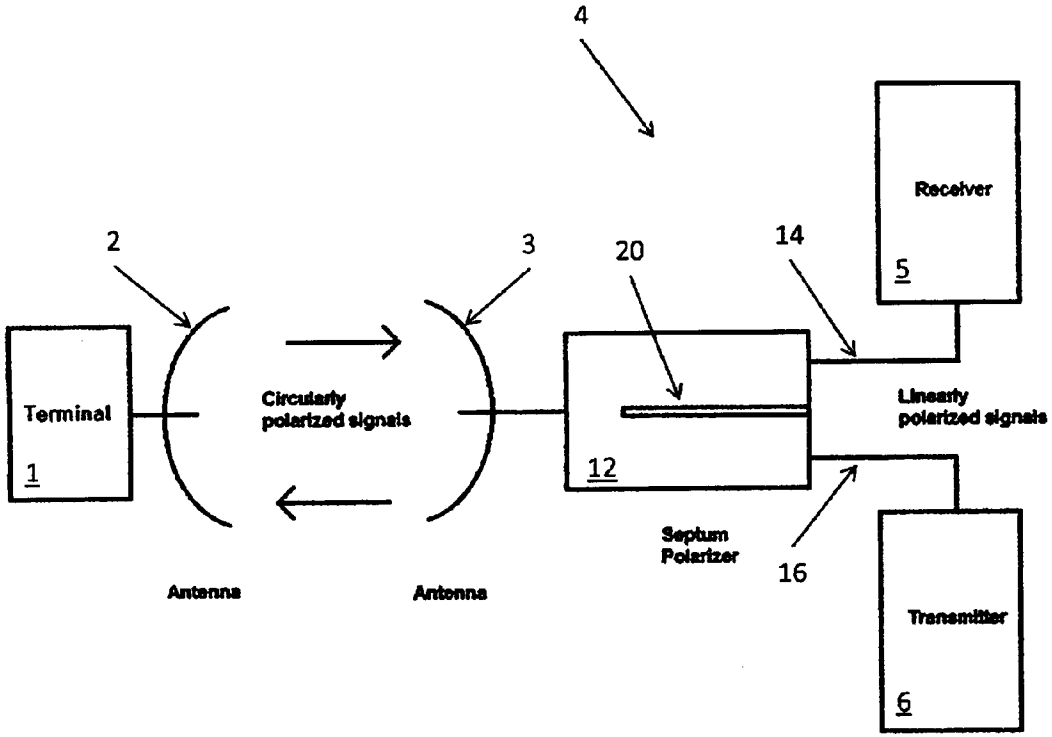

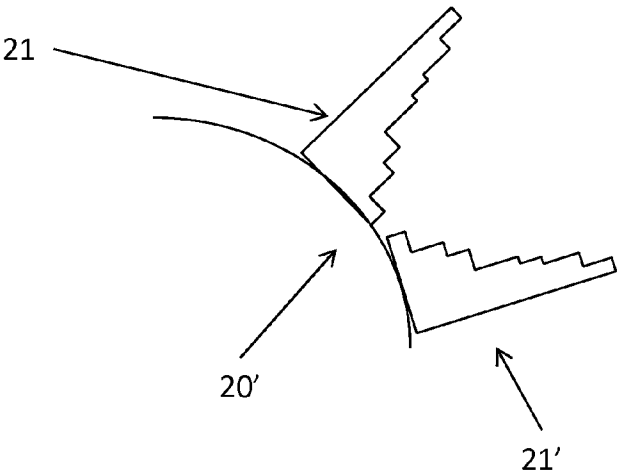
Figure 4
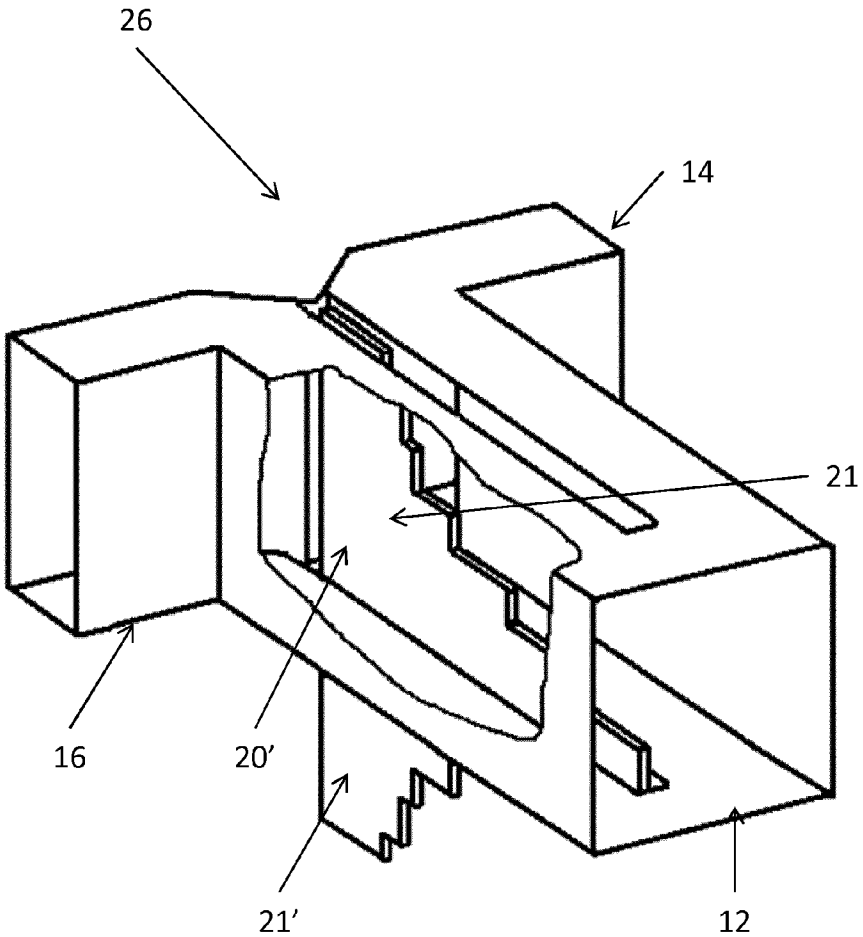

POLARIZER AND A METHOD OF OPERATING THE POLARIZER

CROSS-REFERENCE TO RELATED APPLICATIONS

This is a National Phase of PCT/EP2013/050475, filed on Jan. 11, 2013.

The present invention relates to polarizers and in particular to a particular type of polarizer often called a "septum polarizer" wherein a triangularly shaped metallic element is used for converting between circularly and linearly polarized signal/energy.

A septum polarizer may be seen in KR20100131147.

The present invention relates to an improvement in septum polarizers where the polarizing element may be altered so that the receiver/transmitters may remain in the same positions but the polarization exchanged.

In a first aspect, the invention relates to a polarizer comprising at least one central waveguide and a first and a second waveguide opening into the central waveguide, wherein:

- the first and second waveguides open into one of the central waveguides, the first and second waveguides opening into the one central waveguide at different sides of a plane extending through the one central waveguide and comprising a longitudinal axis of the central waveguide,
- each central waveguide has an opening and comprises therein a polarizing element extending along the longitudinal axis and in the plane, the polarizing element being an electrically conducting element having, when projected on to the plane, a first area on one side of the longitudinal axis and a second area, being smaller than the first area, on another, opposite side of the longitudinal axis, the polarizer being configured to alter between two states, wherein:

- in a first state, the polarizing element of an actual central waveguide, into which the first and second waveguides open, extends in the plane with the first area positioned in a first part of the plane on a first side of the longitudinal axis of the actual waveguide and
- in a second state, the polarizing element of an actual central waveguide, into which the first and second waveguides open, extends in the plane with the first area positioned in a second part of the plane on a second side, opposite to the first side, of the longitudinal axis of the actual waveguide.

In this context, a polarizer is an element which is adapted to alter the polarization of received or transmitted radiation or signals. The present polarizer is configured to convert between linearly polarized and circularly polarized signals and at the same time control or guide the signals within the waveguides.

A number of central waveguides exists. This number may be 1, 2, 3, 4, 5, 6 or more. In a preferred embodiment, a single central waveguide is used. In another embodiment, two central waveguides are used, but more central waveguides may be used if desired.

The first and second waveguides open into the central waveguide so that signals may flow from the central waveguide to the first and second waveguides or vice versa. In one embodiment, one or more waveguides are formed configured to guide a signal between the central waveguide and the first and second waveguide, respectively.

The first and second waveguides may be hollow waveguides for guiding signals or may be other types of signal guides, such as coaxial cables, having one or more conductors extending into the central waveguide so as to derive a signal therefrom and guide it along the waveguide.

The first and second waveguides open into one of the central waveguides. Any additional central waveguides may then be inoperative, even though they may perform the function of receiving, converting and outputting signals.

The first and second waveguides open into the one central waveguide at different sides of a plane extending through the one central waveguide and comprising a longitudinal axis of the central waveguide. The longitudinal axis may be a central axis and/or an axis of symmetry of the central waveguide. Generally, a waveguide may have any shape, but rectangular/square, circular/oval shapes are predominant.

When the polarizing element is an electrically conducting, preferably metallic, element having, when projected on to the plane, a first area on one side of the longitudinal axis and a second area, being smaller than the first area, on another, opposite side of the longitudinal axis, it may perform the function of a so-called septum in a septum polarizer whereby a circularly polarized signal travelling in the central waveguide toward the polarizing element will be converted into a linearly polarized signal travelling, generally, on one side of the polarizing element only. From here, the signal may be guided to one of the first and second waveguides. Right-hand and left-hand polarized signal will be guided to the two opposite sides of the polarizing element. Naturally, the direction of the signals may be reversed, whereby the opposite operation is obtained of the polarizing element.

Naturally, the function of the first and second areas or the corresponding parts of the polarizing element will be defined both by the areas themselves as well as the shapes of the parts of the polarizing element forming the first and second areas. As will be described further below, a generally triangular shape is preferred of the polarizing element and thus also of the projection thereof on to the plane, but deviations thereof are possible. U.S. Pat. No. 4,395,685 describes a number of shapes of a polarizing element forming the function of a septum but having shapes deviating drastically from a single, triangular shape.

In this respect, the first and second areas will usually be the areas delimited by the contour of the projected polarizing element and the longitudinal axis.

At a longitudinal position away, relative to the polarizing element, from the opening of the central waveguide, the contour/areas or polarizing element may be delimited at a position where the polarizing element, in the projection, extends or spans at least 50%, such as at least 75%, such as at least 90% of a width of the central waveguide in the plane. In some situations, the polarizing element may be fixed to the central waveguide, whereby a boundary of the polarizing element at the position of fastening/fixing may be defined at multiple positions.

Preferably, the first area is at least 110%, such as at least 120%, such as at least 130%, such as at least 140%, such as at least 150%, such as at least 160%, such as at least 175% of the second area.

Preferably, the first area, and/or a part of the polarizing element forming the first area, extends further in the longitudinal direction toward the opening than the second area and/or the part of the polarizing element forming the second area. The first area may extend at least 1%, such as at least 2%, such as at least 5%, such as at least 10%, of a distance from the opening to a point of the first area the closest to the opening, further in the longitudinal direction than a point of the second area the closest to the opening.

In one embodiment, a part of the polarizing element, comprising or including the part forming or generating the first area, preferably is at least generally triangular, such as with the shape and constitution described further below. Another part of the polarizing element may have another shape, such as a generally elongate or triangular shape extending along the longitudinal axis. Each central waveguide has an opening, which preferably is configured to receive and/or emit electromagnetic energy. This waveguide may be attached to or connected to other waveguides or an antenna structure, such as a parabolic reflector, if desired.

The plane comprises the longitudinal axis and preferably is a plane of symmetry of the waveguide, if the waveguide has a symmetric cross section.

Naturally, the result of a rotation of one element in one direction may be obtained by rotating instead the remainder of the system in the other direction. In the present context, the first and second states are determined using the same plane. Thus, the plane will remain independently of the rotation/translation of the polarizing element and/or central waveguide. The plane may be determined in the first state and used in the second state, for example. Usually, the longitudinal axis of the actual central waveguide will be the same in the two states, even if multiple central waveguides are used.

The polarizing element has the claimed features, when projected on to the plane, and may generally be a flat element with two parallel sides. Alternatively, the polarizing element may have a non-flat shape, such as a tapering shape, which preferably has a thinner part at a first part of the polarizing element the closest to the opening and a thicker part at the back part thereof. In that situation, a signal travelling in the central waveguide from the opening toward and past the polarizing element will experience a larger and larger polarizer element thickness when travelling along the polarizing element from the first part toward the back part.

The polarizer is configured to alter between the two states. This altering may be performed in a number of manners, as will be described further below.

In general, the plane comprises the longitudinal axis which then divides the plane into a first part on one side thereof and a second part on the other side thereof.

The polarizing element is positioned in the plane, whereby the longitudinal axis extends within at least a part of the polarizing element. Then, the operation of the polarizing element(s) will be to direct received (from the opening) circularly polarized signals toward one of the sides of the polarizing elements, depending on the direction of the polarization of the signal, whereby the first and second waveguides will open into the central waveguide from individual sides of the plane, so that one of the first and second waveguides may receive energy from one side of the polarizing element and of the plane, and the other of the first and second waveguides from another side of the polarizing element/plane.

The first and second waveguides may open into sides of the central waveguide or a bottom portion thereof.

The overall operation of the two states then may be illustrated by viewing the operation when a left-hand circularly polarized signal travels from the opening of the actual central waveguide toward the polarizing element therein. In the first state, the first area is in the first part of the plane, whereas it is in the second part in the second state. Thus, the shape of the polarizing element changes, in the two states, is so that the resulting linearly polarized signal will be generated on one side of the polarizing element in one of the states and on the other side in the other state. The same (but opposite) is the situation for right-hand circularly polarized signals traveling in the central waveguide from the opening toward the polarizing element. Also, the two states will convert a linearly polarized signal received in the central waveguide from one of the first/second waveguides to a right-hand circularly polarized signal in one of the states and a left-hand circularly polarized signal in the other state.

As more than one central waveguide may be provided, the actual central waveguide is that into which the first/second waveguides open. Thus, the operation of any additional central waveguides with polarizing elements is of no importance.

The shape of the polarizing element, naturally, has to fulfil the area definition where, in the plane, the first area is larger than the second area. This may be obtained in a number of manners, and a number of shapes of the polarizing element are known.

Generally, the polarizing element is desired to have a shape with an increasing cross section (in a direction from the opening toward a back of the central waveguide). This may be the situation for both the part defining the first area and that defining the second area.

Preferably, the polarizing element has a generally triangular shape with a longitudinal side, a back side and a third side. The sides may be straight but need not be so. In particular, the third side may be preferred to have a stepped shape, when projected on to the plane, with first elements parallel to the longitudinal sides and second elements interconnecting the first sides. The second sides preferably are perpendicular to the first elements.

In an alternative embodiment, the first area has a triangular shape. Then, the second area may also have a triangular shape, or a part thereof may, together with the first part, form a triangular shape.

The longitudinal side is at least substantially parallel to a first side of the central waveguide in question. Preferably, the longitudinal side contacts the first side, and in some embodiments, the polarizing element is fixed to the first side of the central waveguide, so that the longitudinal side is positioned at an interface between the first side and the polarizing element. Preferably, the longitudinal side is positioned with a distance, to the first side, of no more than 20%, such as no more than 15%, such as no more than 10%, such as no more than 5%, such as no more than 4%, such as no more than 3%, such as no more than 2%, such as no more than 1% of a distance from the first side to the second side in the plane.

The back side of the triangular shape is of minor importance. The polarizing element preferably extends from the first side to a second, opposite side of the central waveguide, but this is not required. Preferably, the polarizing element extends or spans at least 50%, such as at least 55%, such as at least 60%, such as at least 65%, such as at least 70%, such as at least 75%, such as at least 80%, such as at least 85%, such as at least 90%, such as at least 95%, such as at least 96%, such as at least 97%, such as at least 98%, such as at least 99% of the distance from the first side to the second side in the plane. The back side may be fixed to the central waveguide and/or first and/or second waveguide, so that its actual position may be one of many. The back side may be perpendicular to the longitudinal side or not.

The third side is a side defining the actual operation of the polarizing element. This side of the polarizing element preferably extends from one position, where it is closer to the first side than the second side, to a position where it is closer to the second side than to the first side, so that the signal travelling in the central waveguide, in a direction from the opening toward the polarizing element, firstly experiences the first part, where the longitudinal and third sides intersect, and then a larger and larger width, in the plane, and lastly experiences the back side of the polarizing element at which the extent/width of the polarizing element, in the plane, is the largest.

Even though the third side provides a more or less triangular shape with a more or less straight side from the intersection with the longitudinal side to the intersection with the back side, the third side may comprise local maxima or local areas or parts at which the extent or width, in the plane, in the direction from the first side to the second side, forms a convex part directed toward the second surface.

It is noted that the polarizing element may have a portion, at or in the vicinity of the back side, the extent/width of which does not increase, in the plane, and which then may be seen as a part of the polarizing element or a portion of a waveguide extending between the back side of the polarizing element and the first/second waveguides.

It is noted that different triangular shapes, such as different stepped shapes of the third side (step height and length) may be desired for different signal wavelengths of the signals to be converted in the polarizer. The skilled person is well aware of this, as such shapes may be selected as usual in septum polarizers, for example.

In a preferred embodiment, the polarizer has a single central waveguide. In this embodiment, a single polarizing element may be used, which may be fully comprised within the central waveguide. This polarizing element may be fixed within the central waveguide or may be rotationally provided in the central waveguide, such as around an axis of rotation parallel with, such as identical with, the longitudinal axis. Preferably, the axis of rotation is within the plane. In this embodiment, the polarizing element may be a single, triangularly shaped element.

When the polarizing element is rotationally provided in the central waveguide, the central waveguide may be fixed to the first and second waveguides, as the rotation, such as an at least substantially 180 degrees rotation, may bring about the desired change in the polarization characteristics between the two states.

When the polarizing element is fixed to the central waveguide, the central waveguide is preferably configured to be rotated in relation to the first and second waveguides. In this manner, the rotation may be 180 degrees. In addition, also other rotations may be desired. In an interesting embodiment, a plurality of first and/or second waveguides may be provided and which are positioned so as to open into the central waveguide at different angles of rotation of the central waveguide, so that different rotational positions of the central waveguide will have different first/second waveguides open there into. Then, different receivers/transmitters may be provided at/in the first/second waveguides and different types of operation obtained depending on the choice of first/second waveguides and thus angular rotation of the central waveguide. In that embodiment, pairs of a first and a second waveguide may be provided symmetrically around the central waveguide and at different rotational positions. In this situation, the rotation may be around the longitudinal axis or an axis parallel thereto.

It is often desired to have a good electrical connection between the polarizing element and the central waveguide, whereby the embodiment where the polarizing element is fixed to the central waveguide is preferred.

In this connection, the skilled person is aware of different manners of interconnecting waveguides in a rotational relationship, such as the choke arrangement wherein a distance is allowed between the parts but where one part has therein a groove which has dimensions selected in relation to a wavelength of the signals guided.

In one embodiment, the polarizing element is not fixed inside the central waveguide but is movable in relation thereto. Then, in one embodiment, the polarizing element has a first and a second part, each of the first and second parts being an electrically conducting, preferably metallic, element having the above-defined characteristics, but where the parts defining the first areas are positioned between the parts defining the second areas, or the parts defining the second areas are provided between the parts defining the first areas. In the triangular embodiment, this means that the third sides of both the first and second parts or none of the third sides of the first and second parts are provided between the longitudinal sides of the first and second parts, when projected on to the plane.

Thus, the shapes may be said to be inverted so that the positioning of the first part into the central waveguide brings about the first state and the second part brings about the second state.

The altering between the first and second states is a replacement of the first part with the second part within the central waveguide and may be obtained by a simple translation and/or rotation of the polarizing element.

The first and second parts may be selected to have the same cross-sectional shape when projected on to the plane, but inverted or mirrored in an axis perpendicular to a longitudinal side, and potentially subsequently rotated. This, however, is not a requirement.

In another embodiment, the polarizer has more than one central waveguide. Then, each central waveguide is displaceable from an active position wherein the first and second waveguides open into the pertaining central waveguide and an inactive position where the first and second waveguides do not open into the central waveguide.

In one embodiment, the central waveguides are interconnected, such as fixed to each other, and the movement of one central waveguide into and out of the active position is a translation and/or rotation.

In this embodiment, the polarizing elements in the individual central waveguides may be fixed thereto, if desired.

In a second aspect, the invention relates to a method of operating the polarizer of the first aspect of the invention, the method comprising:

I. operating the polarizer in the first state,

II. transforming the polarizer to the second state and

III. operating the polarizer in the second state.

The individual operation steps may be carried out as the operation of a standard septum polarizers, i.e. circularly polarized signals may be received, converted into linearly polarized signals which are fed to the first and/or second waveguides, and/or the signals may travel in the opposite direction. The operation steps may have any time duration, such as seconds, minutes, hours and/or days.

As described above, the transformation from the first to the second state may be performed in a number of manners.

In one embodiment, the polarizer has a single central waveguide, and wherein step II. comprises rotating the polarizing element within the central waveguide. In this situation, the central waveguide may be attached to and/or fixed to the first and/or second waveguides, and the rotation may be a 180 degrees rotation around an axis parallel with the longitudinal axis.

In another embodiment, the polarizing element is fixed to the central waveguide and step II. comprises rotating the central waveguide, such as in relation to the first and/or second waveguides and/or around an axis parallel to the longitudinal axis. In this situation, the above manner of providing a rotational interconnection between waveguides may be used.

In yet another embodiment, the polarizing element has the above-mentioned first and second parts, where step II. then may comprise moving the first part out of the central waveguide and the second part into the central waveguide to go from the first to the second states. The first and second parts may be fixed to each other, and step II. may comprise a rotation and/or translation of the polarizing element.

In a last embodiment, the polarizer has at least two central waveguides. Then, step II. may comprise replacing a first of the central waveguides, which in step I. is positioned in an active position, wherein the first and second waveguides open into the first central waveguides, with a second of the central waveguides, so that the second central waveguide, in step III., is positioned in the active position wherein the first and second waveguides open into the second central waveguides. This replacement step may be a rotation and/or a translation.

Naturally, the above-mentioned translation/rotation of the polarizing element and/or central waveguide(s) may be performed by a moving element, such as a motor, translator/rotator of any type. The moving element may be a linear actuator, such as a linear actuator operating on liquid/gas pressure, a rotating threaded spindle or the like. Alternatively, the movement may be caused by a motor, such as a stepper motor or the like, if desired. This movement may be controlled by a controller of any type, such as an ASIC, an FPGA, a processor (hard-wired or software controlled), of the like. The controller may be connected to one or more sensors determining a position of one or more polarizing elements and/or central waveguides if desired, and the processor may be a single element or a distributed processor if desired.

Also, an operation of a receiver, a transmitter and/or a transceiver connected to or otherwise configured to receive signals from a first/second waveguide and/or transmit signals thereto, may be controlled by the controller if desired.

Figure 2:
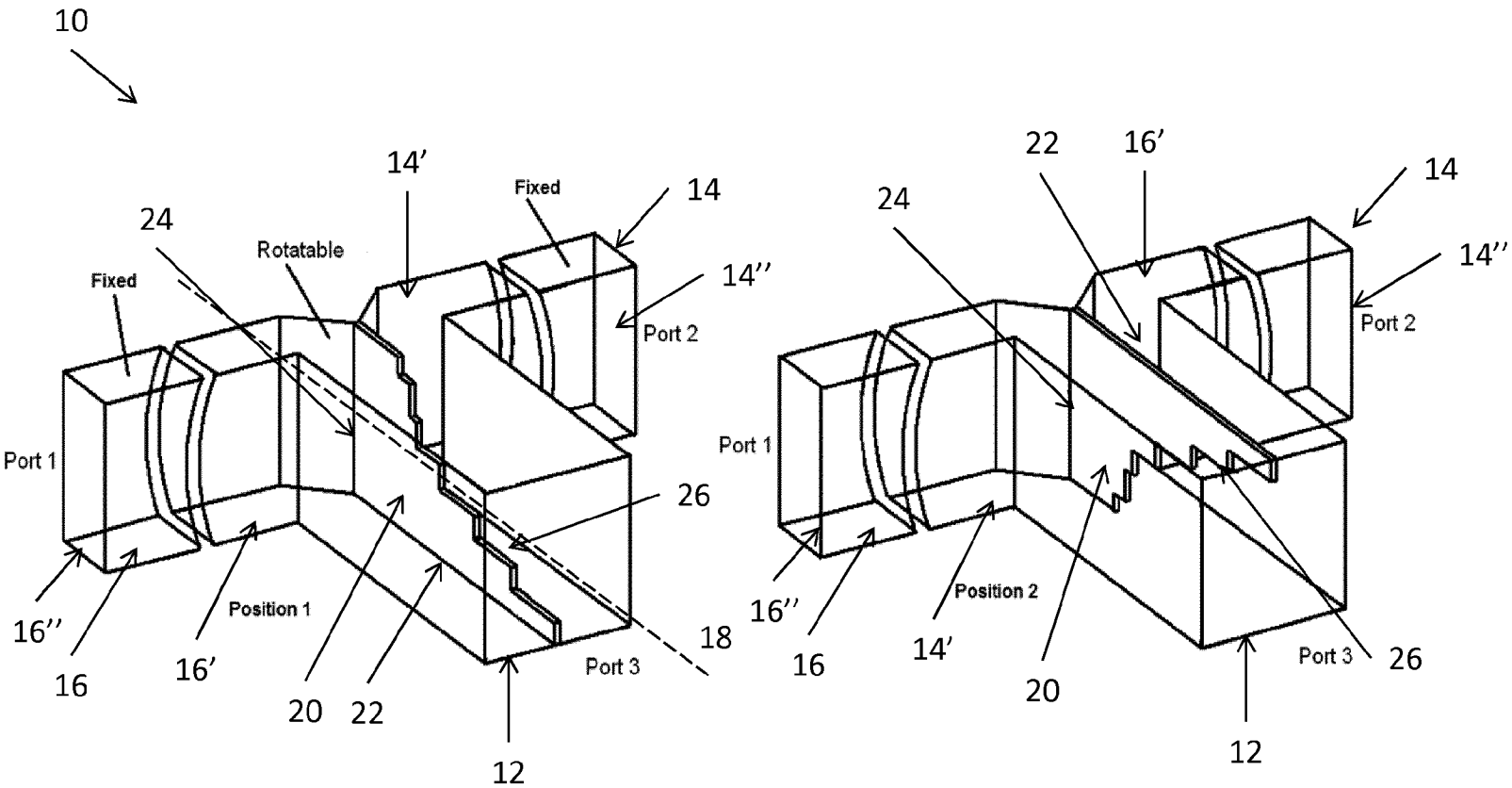
Figure 3:
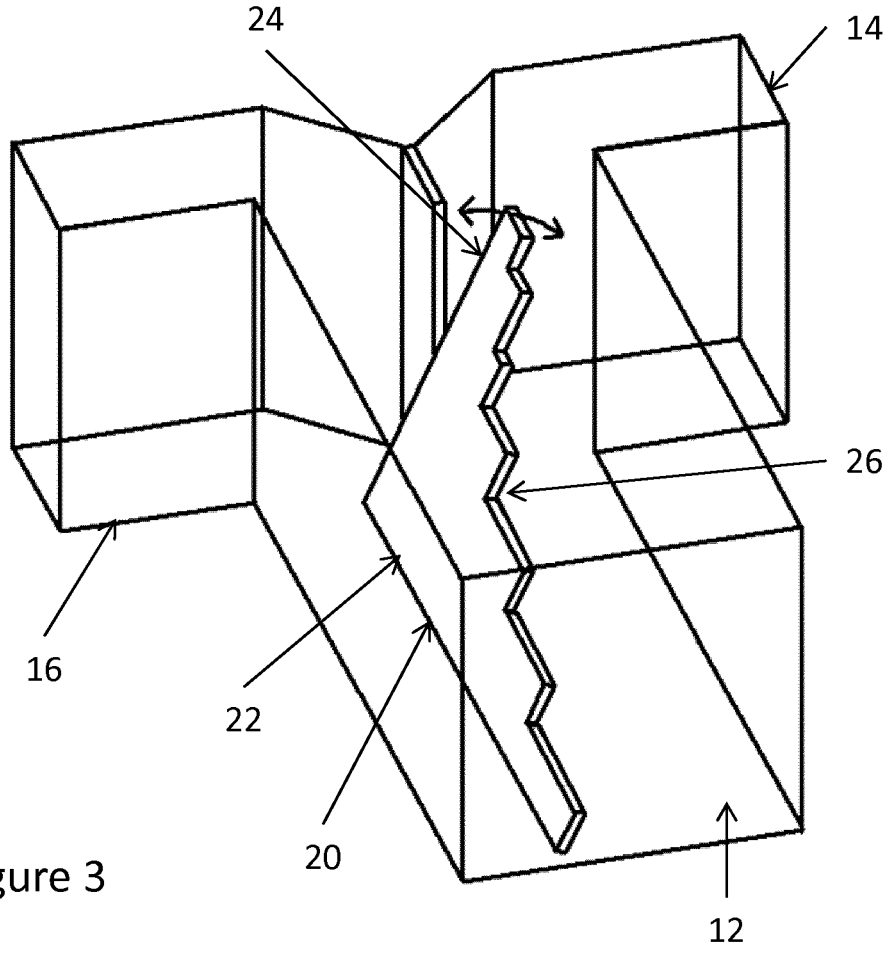
Figure 5:
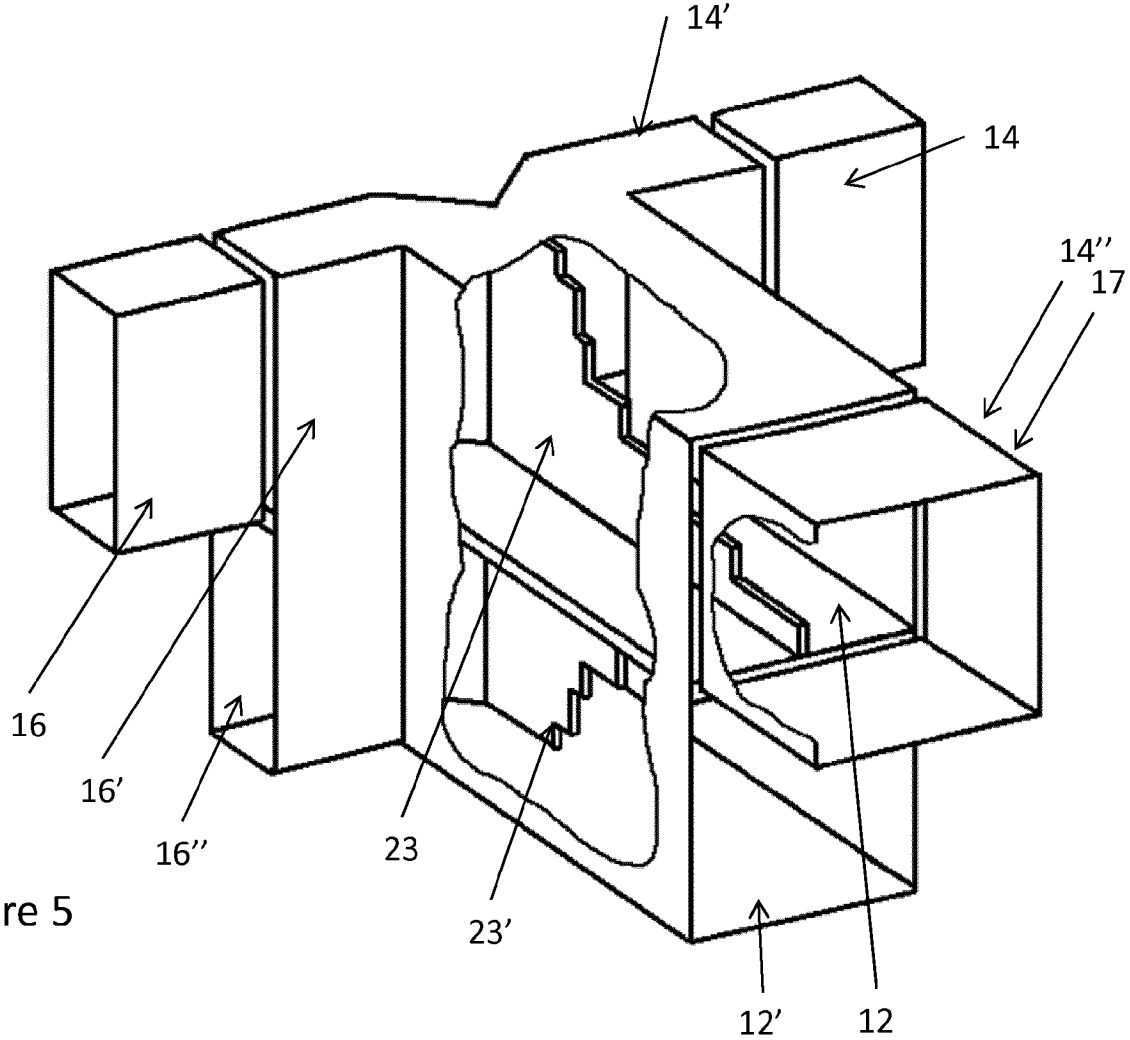
Figure 6:
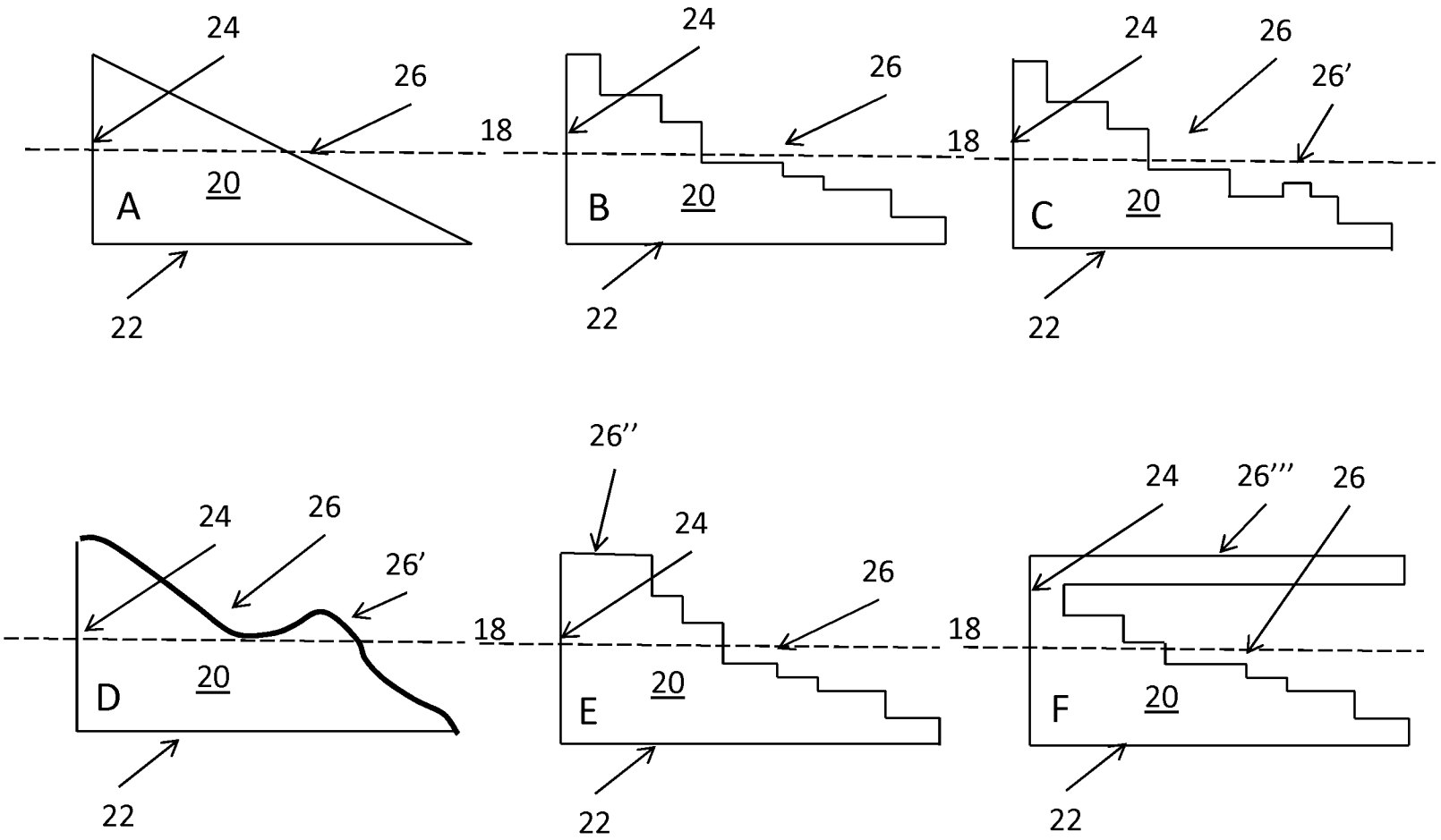
Figure 7:
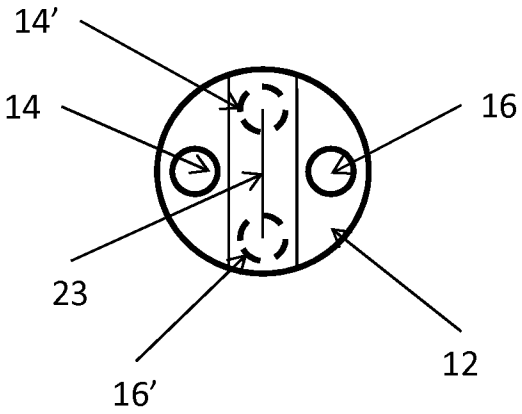
Figure 8:
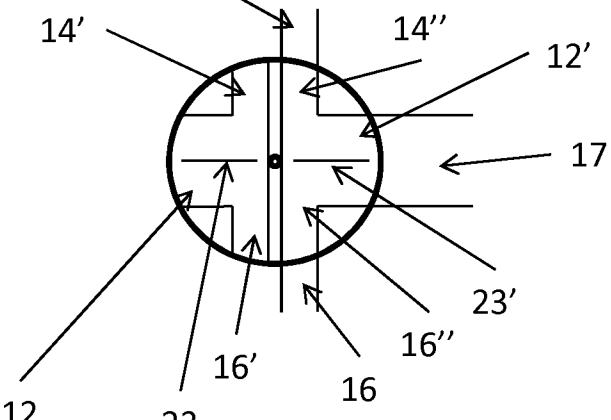

In the following, preferred embodiments will be described with reference to the drawing, wherein:

FIG. 1 in general describes the functionality of a septum polarizer,

FIG. 2 illustrates a first embodiment according to the invention, wherein the polarizer element is rotated together with a part of the central waveguide, FIG. 3 illustrates a second embodiment according to the invention, wherein the polarizer element is rotated within the central waveguide, FIG. 4 illustrates a third embodiment according to the invention, wherein the polarizer element is a translatable element having two parts translatable into and out of the central waveguide, FIG. 5 illustrates a fourth embodiment according to the invention, comprising two polarizer elements each provided in a separate waveguide, one of which is translated in position to become the central waveguide, FIG. 6 illustrates different shapes of polarizing elements for use in the embodiments of the invention, FIG. 7 illustrates an alternative to the embodiment of FIG. 5, and FIG. 8 illustrates yet another embodiment according to the invention.

In FIG. 1, communication between two terminals 1, 4, is illustrated, which usually takes place via parabolic antennas 2 and 3. The signal received at the terminal 4 is received in a central waveguide 12 comprising a polarizing element 20, such as a so-called septum. From the central waveguide 12, a first and a second waveguide, 14 and 16, respectively, extend and lead toward a receiver 5 and a transmitter 6, respectively.

The function of the septum or polarizing element 20 is that circularly polarized signals are converted into a linearly polarized signal which is fed to one of the waveguides 14 and 16, depending on whether the received circularly polarized signal is left-hand or right-hand circularly polarized.

When the signals travel in the other direction, the opposite occurs: the transmitter 6 emits a linearly polarized signal, which on its way though the central waveguide 12 is converted by the polarizing element 20 into a circularly polarized signal which is fed to the remote terminal 1.

In one example, the terminal 1 is a satellite and the terminal 4 a ground based terminal, such as an antenna on a vessel, whereby a point-to-point communication is set up.

In FIG. 2, a polarizer 10 according to the invention is seen having the central waveguide 12, the first waveguide 14 and the second waveguide 16 as well as the polarizing element 20. The polarizing element 20 has a generally triangular shape and has a longitudinal side 22, a back side 24 and a third side 26.

The longitudinal side 22 is parallel to a longitudinal axis 18 of the central waveguide 12, and the back side 24 is perpendicular to the longitudinal side 22.

The shape of the polarizing element 20 provides the function of the septum in a septum polarizer as described with reference to FIG. 1.

If a polarizing element 20 was provided in the central waveguide which was rotated 180 degrees, the same received circularly polarized signal would be again converted into a linearly polarized signal but now fed to the other of the first and second waveguides 14/16, respectively.

In this other mode, the polarizing element 20 would still be positioned din the same plane, which comprises the longitudinal axis of the central waveguide, in the central waveguide, but the longitudinal side 22 would shift from one side of the plane, compared to the longitudinal axis, to the other.

In the first embodiment, these two modes are altered between by rotating the central waveguide 12 together with the polarizing element 20, as well as a proximal part 14'/16' of the first and second waveguides 14/16, respectively, whereas distal parts 14" and 16" of the first and second waveguides, respectively, may remain fixed and connected to signal receiver/transmitters, for example.

This embodiment has the advantage that the signal connection between the rotating parts 14'/16' and the fixed, distal parts 14"/16", respectively, may be retained by simple choke arrangements at the junctions. There is therefore no contact issue between the proximal and distal parts 14', 14", 16' and 16". It is noted that before and after rotation, the longitudinal axis remains the same and the plane is the same.

In FIG. 3, another embodiment is seen in which, again, the polarizing element 20 is provided fully within the central waveguide 12. Again, the first and second waveguides 14/16 are provided.

In this embodiment, the polarizing element 20 is rotatable around an axis parallel with the longitudinal axis 18 (see FIG. 2) of the central waveguide, from a first position to a second position wherein, in the drawing, the longitudinal side 22 is at an upper position and a lower position, respectively.

This embodiment has the advantage that only the polarizing element 20 is rotated, which can be accomplished by simple means (e.g. a small motor). Another advantage is that the polarizer can be changed to cover other frequency bands by only replacing the polarizing element 20. The electrical contact along the sides of the polarizing element 20 can be retained by finger stock gaskets or similar arrangements.

In FIG. 4, a third embodiment is illustrated in which the polarizing element 20' is translatable in an up/down movement. The polarizing element 20' has two parts 21 and 21', which may sequentially be positioned within the central waveguide 12.

When the part 21 is provided in the central waveguide, the resulting linearly polarized signal will be fed to e.g. the first waveguide 14, whereas it will be fed to the second waveguide 16, when the other part 21' is provided in the waveguide 12.

In the upper right corner, an element 20' is illustrated where the interchanging of the part 21 with the part 21' is performed using a rotation instead.

This embodiment has the advantage that only the element 20' is moved, which also here can be accomplished by simple means. Another advantage is that the polarizer can be changed to cover other frequency bands by replacing only the element 20' or even providing, in the element 20' elements 21/21' which are adapted to different frequency bands, so that the rotation or translation may be used also for changing frequency bands. The longitudinal slot in the waveguide 12 is shown for illustrative purposes only. This slot preferably is covered by metallic 'lids' which may be attached to the polarizing element 20'. The electrical contact along the sides of the polarizing element 20' can be retained by finger stock gaskets or similar arrangements.

In FIG. 5, a fourth embodiment is illustrated wherein two individual polarizing elements 23 and 23' each is provided in a waveguide 12 and 12', respectively, which are connected to proximal dual waveguide elements 14' and 16' and 14" (not illustrated) and 16", respectively, such that when the upper waveguide 12 and the upper polarizing element 23 is used, the channel 12 receives a circularly polarized signal from a receiving waveguide 17, the polarizing element 23 converts the circularly polarized signal into the linearly polarized signal which is fed to one of the first and second, distal waveguides 14 and 16 via one of the waveguides 14' and 16'.

When it is desired to have the linearly polarized signal fed to the other of the distal waveguides 14/16, the waveguide 12' is used wherein the polarizing element 23' is provided, feeding the signal to one of the waveguides 14"/16". This shift is provided by shifting the central element with the channels 12, 12', 14', 16', 14" and 16" and polarizing elements 23 and 23' upwardly or downwardly.

This embodiment has the advantage that there is no contact issue between the polarizing element itself and the surrounding waveguide. The contact at the waveguide junctions can be retained by simple choke arrangements. Naturally, the two polarizing elements 23 and 23' may be replaced by the polarizing element 20' of FIG. 4, such that a single element is used instead of the two individual elements.

In FIG. 7, an alternative embodiment is seen in a cross section where the longitudinal axis is right-to-left in the drawing. The two central waveguides 12 and 12' are seen, as are the proximal waveguides 14', 14", 16' and 16" as well as distal waveguides 14 and 16. The polarizing elements 23 and 23' are also illustrated, and it is clear that a rotation around the rotation axis indicated (dot; axis extending out of the plane) will bring the waveguide 12 to the position of the waveguide 12' and thus connect the waveguides 16' and 14' to 14 and 16, respectively.

Naturally, the first and second waveguides may extend in other directions than perpendicular to the central waveguide 12/12', such as parallel thereto or any other direction. These waveguides may be symmetric about a plane defined by the polarizing element or not.

The waveguides are illustrated as quadratic/rectangular, but other shapes may also be used, such as circular, oval, or the like.

In FIG. 6, different shapes of polarizing elements 20/20'/23/23' are illustrated. The main shape of the polarizing element to fulfil this function preferably is generally triangular. However, as will also be clear from the following, adaptations to this shape are possible.

In illustration A, the polarizing element 20 is a simple triangle with the longitudinal side 22, the back side 24 and a straight third side 26.

In illustration B, the third side 26 is not straight but step-shaped. Still, the third side is generally approaching the longitudinal side 22 from left to right.

In illustration C, a step-shaped third side 26 is illustrated which, however, has a local maximum 26', i.e. a part which, from left to right, locally increases the distance between the longitudinal side (vertical in the drawing) and the third side.

In illustration D, the third side has a smooth, non-linear shape. Again, a local maximum 26' is illustrated, and again, the operation of the polarizing element is retained.

In illustration E, the third side 26 is again step-shaped, but a longer "top part" 26" is illustrated. This part 26" is not relevant to the operation of the polarizing element 20, as the main function is that of the height-reducing part—illustrated here as the step-shaped part.

Comparing this illustration to FIG. 3, it is seen that the "top part" 26" may be rotated with the remainder of the polarizing element 20 or may remain fixed in relation to the main waveguide 12, as illustrated in FIG. 3. The polarizing effect is determined by the sloping part of the polarizing element 20, and any extension thereof or dividing of the waveguide 12 subsequent (in the travel direction of the signal in the waveguide 12) is of no or little importance in this respect.

Finally, in illustration F, an elongate element 26" is seen directed along the longitudinal axis but increasing the area of the cross section above the longitudinal axis. The advantages of this type of polarizing element may be seen in U.S. Pat. No. 4,395,685 where also other shapes of this type are illustrated and described. It is seen that the first area, below the longitudinal axis, is generally triangular, as is the first area with a part of the second area (from the bottom to the waist below the part 26").

In FIG. 8, yet another embodiment is illustrated seen along the longitudinal axis into the central waveguide 12 wherein the polarizing element 23 is positioned and from which the first and second waveguides 14 and 16 open. It is seen that the first and second waveguides open at the back of the channel 12.

Two additional sets of channels 14' and 16' are illustrated. These are blinded when the polarizing element 23 is in the illustrated position, but a rotation of 90 degrees will open these into the central channel 12.

Rotation 180 degrees is as that described in relation to e.g. FIG. 3, but a 90 degrees rotation will open into two different channels 14' and 16'.

The invention claimed is:

1. A polarizer comprising:

a central waveguide, the central waveguide including, a plane extending through the central waveguide along a longitudinal axis of the central waveguide, an opening, and a polarizing element extending along the longitudinal axis and in the plane, the polarizing element being an electrically conducting element having, when projected on to the plane, a first area on one side of the longitudinal axis and a second area on an opposite side of the longitudinal axis, the second area being smaller than the first area, the polarizer being configured to alter between two states, such that, in a first state, the polarizing element extends in the plane with the first area positioned in a first part of the plane on a first side of the longitudinal axis, and in a second state, the polarizing element extends in the plane with the first area positioned in a second part of the plane on a second side of the longitudinal axis, the second side being opposite to the first side; and a first waveguide and a second waveguide opening into the central waveguide at different sides of the plane extending through the central waveguide.

2. A polarizer according to claim 1, wherein, the polarizing element has a generally triangular shape including, a longitudinal side extending at least substantially parallel to a first side of the central waveguide, a back side extending at least substantially from the first side of the central waveguide to a second, opposite side of the central waveguide, and a third side, and a first part of the polarizing element, positioned where the longitudinal side and the third side intersect, is closer to the opening of the central waveguide than the back side of the polarizing element, wherein, in the first state, the polarizing element of the central waveguide extends in the plane with the longitudinal side extending in the first part of the plane, and in the second state, the polarizing element of the central waveguide extends in the plane with the longitudinal side extending in the second part of the plane.

3. A polarizer according to claim 2, wherein the third side of the polarizing element has a stepped shape, when projected on to the plane.

4. A polarizer according to claim 1, wherein the polarizing element is rotationally provided in the central waveguide.

5. A polarizer according to claim 1, wherein the polarizing element is fixed to the central waveguide and the central waveguide is configured to be rotated in relation to the first and second waveguides.

6. A polarizer according to claim 1, wherein, the polarizing element has a first and a second part, each of the first and second parts being an electrically conducting element having, when projected on to the plane, a first area on one side of the longitudinal axis and a second area, being smaller than the first area, on another, opposite side of the longitudinal axis, and the first areas of both the first and second parts are provided between the second areas of the first and second parts or the second areas are provided between the first areas of the first and second parts.

7. A polarizer according to claim 1, comprising:

at least one additional central waveguide in addition to the central waveguide, the central waveguide and the at least one additional central waveguide each being displaceable from an active position, wherein the first and second waveguides open into the central waveguide or the at least one additional waveguide, and an inactive position where the first and second waveguides do not open into any of the central waveguide or the at least one additional waveguide.

8. A method of operating the polarizer according to claim 1, the method comprising:

operating the polarizer in the first state, transforming the polarizer to the second state and operating the polarizer in the second state.

9. A method according to claim 8, wherein transforming the polarizer to the second state includes rotating the polarizing element within the central waveguide.

10. A method according to claim 8, wherein, the polarizing element is fixed to the central waveguide, and transforming the polarizer to the second state includes rotating the central waveguide.

11. A method according to claim 8, wherein, the polarizing element has a first part and a second part, each of the first part of the polarizing element and the second part of the polarizing element being an electrically conducting element having, when projected on to the plane, a generally triangular shape with a longitudinal side extending at least substantially parallel to a first side of the central waveguide, a back side, and a third side, the third sides of both the first part of the polarizing element and the second part of the polarizing element, when projected on to the plane, are either both located in a space between the longitudinal sides of the first part of the polarizing element and the second part of the polarizing element, or both located external to the space between the longitudinal sides of the first part of the polarizing element and the second part of the polarizing element, and transforming the polarizer to the second state includes, moving the first part of the polarizing element out of the central waveguide, and moving the second part of the polarizing element into the central waveguide.

12. A method according to claim 8, wherein, the polarizer includes at least one additional central waveguide in addition to the central waveguide, and transforming the polarizer to the second state includes replacing the central waveguide, positioned in an active position in which the first and second waveguides open into the central waveguide, with the at least one additional central waveguide, such that the at least one additional central waveguide second central waveguide is positioned in the active position in which the first and second waveguides open into the at least one additional central waveguide.

* * * * *